US006619093B2

(12) United States Patent
Dawson et al.

(10) Patent No.: US 6,619,093 B2
(45) Date of Patent: Sep. 16, 2003

(54) CONTINUOUS EXTRUSION APPARATUS

(75) Inventors: John Dawson, Canterbury (GB); Daniel John Hawkes, Ashford (GB); Philip A. Jones, Guernsey (GB); Stephen James Laidlow, Ashford (GB)

(73) Assignee: BWE Limited, Ashford (GB)

( * ) Notice: Subject to any disclaimer, the term of this patent is extended or adjusted under 35 U.S.C. 154(b) by 0 days.

(21) Appl. No.: 10/086,634

(22) Filed: Mar. 4, 2002

(65) Prior Publication Data

US 2002/0121121 A1 Sep. 5, 2002

Related U.S. Application Data

(63) Continuation of application No. PCT/GB00/03959, filed on Oct. 12, 2000.

(30) Foreign Application Priority Data

Oct. 12, 1999 (GB) ..... 9924160

(51) Int. Cl.[7] ..... B21C 23/00
(52) U.S. Cl. ..... 72/262; 72/271
(58) Field of Search ..... 72/259, 262, 269, 72/271

(56) References Cited

U.S. PATENT DOCUMENTS

| | | | | |
|---|---|---|---|---|
| 4,598,567 A | | 7/1986 | Backus | |
| 5,152,163 A | * | 10/1992 | Hawkes et al. | 72/262 |
| 5,284,428 A | * | 2/1994 | Sinha et al. | 72/262 |
| 5,595,084 A | * | 1/1997 | Yano | 72/262 |
| 5,813,270 A | | 9/1998 | Carter | |

FOREIGN PATENT DOCUMENTS

| | | | | |
|---|---|---|---|---|
| EP | 0 398 747 | | 11/1990 | |
| EP | 0 822 016 | | 2/1998 | |
| GB | 2 078 584 | | 1/1982 | |
| GB | 2103527 | * | 2/1983 | 72/262 |
| GB | 2 209 295 | | 5/1989 | |
| GB | 2 326 121 | | 12/1998 | |
| JP | 57-159213 | * | 10/1982 | 72/262 |
| JP | 59-223113 | * | 12/1984 | 72/262 |

OTHER PUBLICATIONS

International Search Report (3 pgs.) for PCT/GB00/03959, dated Feb. 1, 2001.

* cited by examiner

*Primary Examiner*—Ed Tolan
(74) *Attorney, Agent, or Firm*—Shlesinger, Arkwright & Garvey LLP

(57) ABSTRACT

Continuous extrusion apparatus for the production of copper tubing having a rotatable wheel formed with a plurality of circumferential grooves registering with (as shown in FIG. 1) abutments 4 formed on a die top 2. Respective exit apertures 6 each have a cross-sectional area of between two and five times the radial cross-section of the associated groove and lead to a passage 8 smoothly diverging to connect into an extrusion die chamber 10 housing an annular extrusion die (not shown). The appartus produces an extrudate in the form of a continuous, seamless, copper tube having a mass in excess of 500 kilograms extruded at a temperature of approximately 750 degrees Celsius.

18 Claims, 1 Drawing Sheet

CONTINUOUS EXTRUSION APPARATUS

CROSS REFERENCE TO RELATED APPLICATIONS

This application is a continuation of Application No. PCT/GB00/03959, filed Oct. 12, 2000, which claims the priority of United Kingdom Application No. 9924160.6, filed Oct. 12, 1999, and each of which is incorporated herein by reference.

This application relates to Applicant's co-pending application filed Mar. 1, 2002 (Ser. No. 10/086,622), which is incorporated herein by reference.

FIELD OF THE INVENTION

This invention relates to continuous extrusion apparatus for the forming of metals by a continuous extrusion process in which feedstock is introduced into a plurality of circumferential grooves in a rotating wheel to pass into passageways formed between the grooves and arcuate tooling extending into the grooves.

BACKGROUND OF THE INVENTION

WO96/29162 discloses continuous extrusion apparatus for the production of copper tubing having a rotatable wheel formed with a plurality of circumferential grooves provided with exit apertures in a die top and abutments displaced in the direction of rotation from the exit apertures.

DETAILED DESCRIPTION OF THE INVENTION

According to the present invention, each of the plurality of circumferential grooves is provided with an exit aperture in the die top having a cross-sectional area in excess of twice the radial cross-sectional area of the associated groove and smoothly leading to a passage of minimum length to connect into an annular extrusion die.

Preferably, the exit aperture has a cross sectional area of three times the radial cross-sectional area of the associated groove.

Suitably, the exit aperture has a cross-sectional area of four times the radial cross-sectional area of the associated groove.

Desirably, the exit aperture has a cross-sectional area of five times the radial cross-sectional area of the associated groove.

The invention also includes an extrudate product in the form of a continuous, seamless, copper tube having a mass in excess of 500 kilograms.

It will be understood that the term seamless relates to copper tube formed as a tube by an extrusion process as distinct from a copper tube formed by edge joining a strip or strips along abutting edges.

Figure 1:
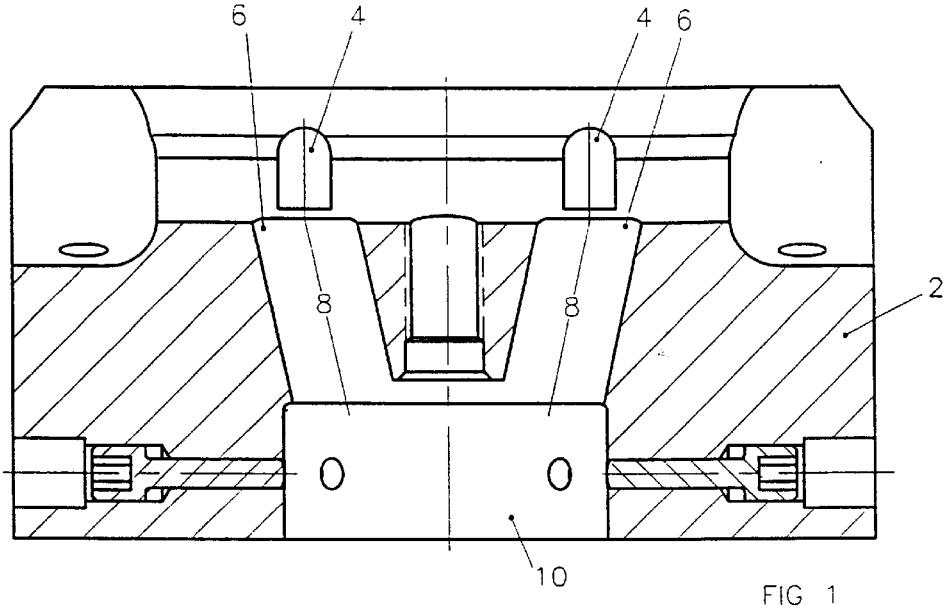
Figure 2:
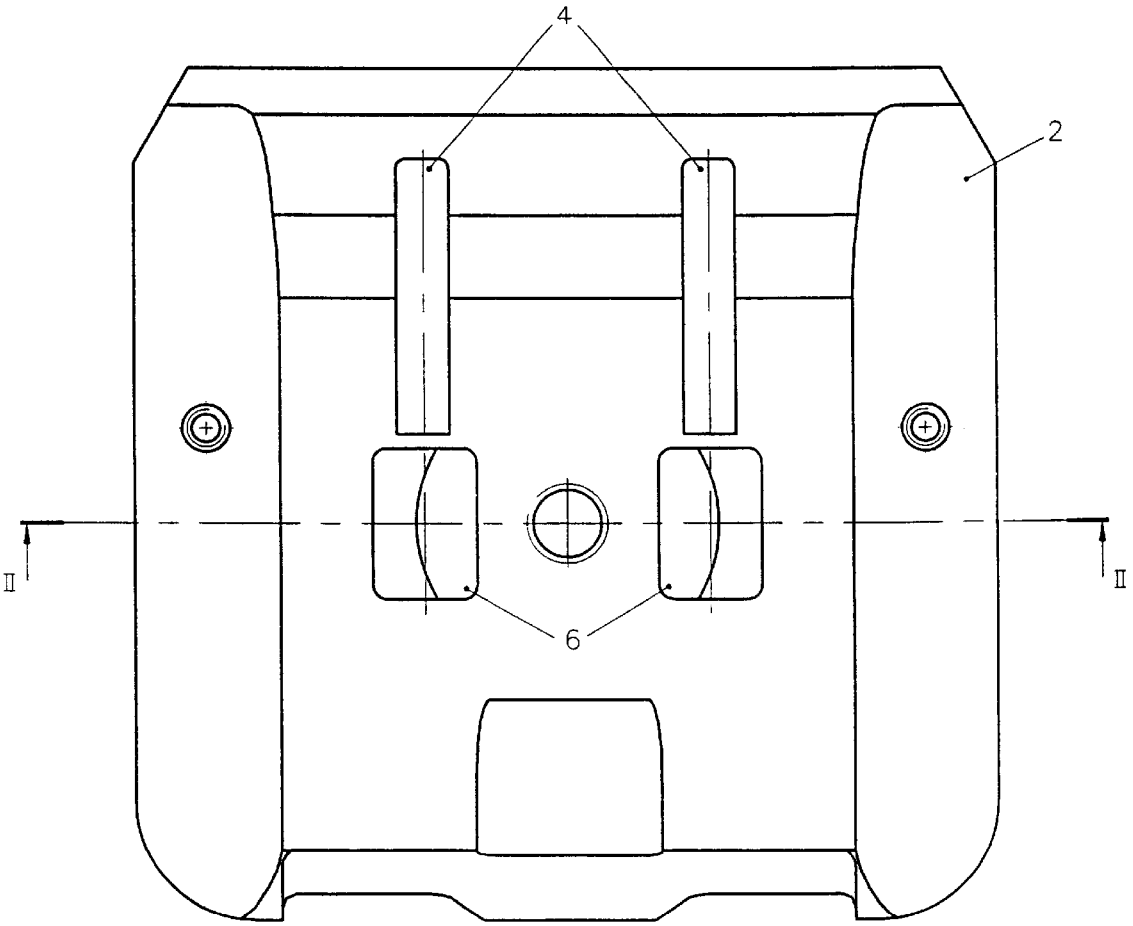

In one embodiment of the invention, in which FIG. 1 shows a cross-section of a die top 2 corresponding to the plan view of FIG. 2, a rotatable wheel (not shown) is formed with a pair of circumferential grooves registering with abutments 4 formed on the die top 2. Adjacent each abutment 4, the die top 2 is provided with an exit aperture 6 having a cross-sectional area of approximately five times the radial cross-section of the associated groove. Each aperture leads to a passage 8 smoothly diverging to connect into an extrusion die chamber 10 housing an annular extrusion die (not shown).

In operation, feedstock in the form of continuous rods of copper is fed to each of the grooves and, as the wheel rotates, extrudes through the exit apertures 6 adjacent the abutments 4 and the passages 8 and is extruded from the annular extrusion die in the die chamber 10 as seamless copper tubing. Since the passages 8 are of minimum length, the two flows of extrudate through the passages combine at the annular die at a pressure only slightly lower than the pressure obtaining in the material in the grooves immediately adjacent the exit apertures 6, with a resultant extrusion temperature at the annular die of approximately 750° C. as compared with a temperature of approximately 650° C. achieved in prior art arrangements.

The relatively high temperature and pressure at the annular die enables the extrusion of sound, thin-walled, copper tubing without imperfections likely to arise from combining flows of extrudate at lower temperatures and pressures.

It will be appreciated that there is no limitations on the length of seamless copper tubing that may be produced in this manner, so that reels of 500 kilograms or more of continuous seamless copper tubing may be produced. Hitherto, utilising conventional extrusion techniques, it has not been possible to produce seamless, copper tubing in a continuous length of such a mass, even though there is a commercial demand for reels of continuous seamless copper tubing of a mass of 500 kilograms or more.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Continuous extrusion apparatus for the production of copper tubing, comprising:

a) a rotatable wheel formed with a plurality of circumferential grooves provided with exit apertures in a die top;

b) abutments displaced in the direction of rotation from the exit apertures;

c) each of the plurality of circumferential grooves being provided with an exit aperture in the die top having a cross sectional area in excess of substantially twice the radial cross-sectional area of the associated groove and smoothly leading to a passage of minimum length to connect into an annular extrusion dies and d) the exit aperture of the plurality of circumferential grooves smoothly leading to the passage of minimum length combining two flows of an extrudate, in use, at a pressure only slightly lower than the pressure obtaining in an extrusion material in the plurality of grooves immediately adjacent the exit aperture, so that, in use, a resultant extrusion temperature at the annular extrusion die is approximately 750° C.

2. Continuous extrusion apparatus as claimed in claim 1, wherein:

a) the exit aperture has a cross-sectional area of two times the radial cross-sectional area of the associated groove.

3. Continuous extrusion apparatus as claimed in claim 1, wherein:

a) the exit aperture has a cross-sectional area of three times the radial cross-sectional area of the associated groove.

4. Continuous extrusion apparatus as claimed in claim 1, wherein:

a) the exit aperture has a cross-sectional area of four times the radial cross-sectional area of the associated groove.

5. Continuous extrusion apparatus as claimed in claim 1, wherein:

a) the exit aperture has a cross-sectional area of five times the radial cross-sectional area of the associated groove.

6. A continuous extrusion apparatus as claimed in claim 5, wherein:

a) an extrudate product produceable, in use, is in the form of a continuous, seamless, copper tube having a mass in excess of 500 kilograms.

7. A continuous extrusion apparatus as claimed in claim 4, wherein:

a) an the extrudate product is produceable, in use, in the form of a continuous, seamless, copper tube having a mass in excess of 500 kilograms.

8. A continuous extrusion apparatus as claimed in claim 3, wherein:

a) an extrudate product is produceable, in use, in the form of a continuous, seamless, copper tube having a mass in excess of 500 kilograms.

9. A continuous extrusion apparatus as claimed in claim 2, wherein:

a) an the extrudate product is produceable, in use, in the form of a continuous, seamless, copper tube having a mass in excess of 500 kilograms.

10. A method of producing copper tubing, comprising:

a) providing a continuous extrusion apparatus including:

1) a rotatable wheel formed with a plurality of circumferential grooves provided with exit apertures in a die top;

2) abutments displaced in the direction of rotation from the exit apertures;

3) each of the plurality of circumferential grooves being provided with an exit aperture in the die top, the exit aperture having a cross-sectional area in excess of substantially twice the radial cross-sectional area of the respective groove, and the respective exit aperture smoothly leading to a passage of minimum length to connect to an annular extrusion die; and 4) the respective exit apertures of the plurality of circumferential grooves smoothly leading to the passage of minimum length combining two flows of an extrudate, in use, at a pressure only slightly lower than the pressure obtaining in an extrusion material in the plurality of grooves immediately adjacent the respective exit apertures, so that, in use, a resultant extrusion temperature at the annular extrusion die is approximately 750° C.;

b) feeding continuous rods of copper to each of the circumferential grooves;

c) rotating the rotatable wheel; and d) extruding the feedstock adjacent the abutments through the exit apertures and passages and then from the annular extrusion die to form copper tubing having an extrusion temperature of approximately 750° C.

11. The method as claimed 10, in claim wherein:

a) the exit aperture has a cross-sectional area of two times the radial cross-sectional area of the associated groove.

12. The method as claimed in claim 10, wherein:

a) the exit aperture has a cross-sectional area of three times the radial cross-sectional area of the associated groove.

13. The method as claimed in claim 10, wherein:

a) the exit aperture has a cross-sectional area of four times the radial cross-sectional area of the associated groove.

14. The method as claimed in claim 10, wherein:

a) the exit aperture has a cross-sectional area of five times the radial cross-sectional area of the associated groove.

15. The method as claimed in claim 14, wherein:

a) an extrudate product is produceable, in use, in the form of a continuous, seamless, copper tube having a mass in excess of 500 kilograms.

16. The method as claimed in claim 13, wherein:

a) an extrudate product is produceable, in use, in the form of a continuous, seamless, copper tube having a mass in excess of 500 kilograms.

17. The method as claimed in claim 12, wherein:

a) an extrudate product is produceable, in use, in the form of a continuous, seamless, copper tube having a mass in excess of 500 kilograms.

18. The method as claimed in claim 11, wherein:

a) an extrudate product is produceable, in use, in the form of a continuous, seamless, copper tube having a mass in excess of 500 kilograms.

* * * * *